US007898367B2

(12) United States Patent
Morga et al.

(10) Patent No.: US 7,898,367 B2
(45) Date of Patent: Mar. 1, 2011

(54) CERAMIC MONOBLOCK FILTER WITH METALLIZATION PATTERN PROVIDING INCREASED POWER LOAD HANDLING

(75) Inventors: Justin R. Morga, Edgewood, NM (US); Jeffrey J. Nummerdor, Rio Rancho, NM (US); Scott Burgess, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 120 days.

(21) Appl. No.: 12/157,532

(22) Filed: Jun. 11, 2008

(65) Prior Publication Data

US 2008/0309434 A1 Dec. 18, 2008

Related U.S. Application Data

(60) Provisional application No. 60/934,863, filed on Jun. 15, 2007.

(51) Int. Cl.
*H01P 1/205* (2006.01)

(52) U.S. Cl. ..... 333/202; 333/206

(58) Field of Classification Search ..... 333/202, 333/206, 134

See application file for complete search history.

(56) References Cited

U.S. PATENT DOCUMENTS

| | | | | |
|---|---|---|---|---|
| 4,431,977 | A | 2/1984 | Sokola et al. | |
| 4,896,124 | A | 1/1990 | Schwent | |
| 6,462,629 | B1 * | 10/2002 | Blair et al. | 333/134 |
| 6,498,543 | B2 | 12/2002 | Kim et al. | |
| 6,559,735 | B1 | 5/2003 | Hoang et al. | |
| 6,570,467 | B2 | 5/2003 | Walker et al. | |
| 6,650,202 | B2 | 11/2003 | Rogozine et al. | |
| 6,724,279 | B1 * | 4/2004 | Kitajima et al. | 333/134 |
| 6,809,612 | B2 | 10/2004 | Bloom et al. | |
| 6,828,883 | B1 * | 12/2004 | Kitajima et al. | 333/206 |
| 2002/0070820 | A1 | 6/2002 | Walker et al. | |
| 2006/0261913 | A1 | 11/2006 | Ye | |
| 2006/0267712 | A1 | 11/2006 | Morga | |

FOREIGN PATENT DOCUMENTS

| | | |
|---|---|---|
| WO | WO 01/52344 | 7/2001 |

OTHER PUBLICATIONS

Pastor Jiménez, J, PCT International Search Report mailed Sep. 29, 2008 re: International Application No. PCT/US2008/007407 filed Jun. 13, 2008.

Pastor Jiménez, J, PCT Written Opinion of the International Searching Authority mailed: Sep. 29, 2008 re: International Application No. PCT/US2008/007407 filed Jun. 13, 2008.

Top Pattern of CTS Corporation KFF6651A Filter, 2000.

Top Pattern of CTS Corporation KFF6680A Filter, 2000.

Top Pattern of CTS Corporation CER0429A Filter, 2005.

* cited by examiner

*Primary Examiner*—Benny Lee
(74) *Attorney, Agent, or Firm*—Daniel J. Deneufbourg

(57) ABSTRACT

A ceramic monoblock filter incorporating a top face input/output port metallization pattern defining an input/output transmission line, a power load distribution bar, and a ground plate. The transmission line, power load distribution bar, and ground plate are all positioned and oriented relative to each other and two of the resonators defining the filter to define load splitting capacitors providing increased power load handling characteristics.

15 Claims, 6 Drawing Sheets

CERAMIC MONOBLOCK FILTER WITH METALLIZATION PATTERN PROVIDING INCREASED POWER LOAD HANDLING

CROSS-REFERENCE TO RELATED APPLICATION

This application claims the benefit of the filing date of U.S. Provisional Application Ser. No. 60/934,863 filed on Jun. 15, 2007, which is explicitly incorporated herein by reference as are all references cited therein.

FIELD OF THE INVENTION

This invention relates to electrical filters and, in particular, to a dielectric ceramic monoblock filter which incorporates a metallization pattern on the top surface thereof adapted and structured to provide an increase in a filter's power load handling capability.

BACKGROUND OF THE INVENTION

Ceramic dielectric block filters offer several advantages over air-dielectric cavity filters. The blocks are relatively easy to manufacture, rugged, and relatively compact. In the basic ceramic block filter design, resonators are formed by cylindrical passages called through-holes which extend between opposed top and bottom surfaces of the block. The block is substantially plated with a conductive material (i.e., metallized) on all but one of its six (outer) sides and on the interior walls of the resonator through-holes.

The top surface is not fully metallized but instead bears a metallization pattern designed to couple input and output signals through the series of resonators. In some designs, the pattern may extend to the sides of the block, where input/output electrodes or pads are formed.

The reactive coupling between adjacent resonators is dictated, at least to some extent, by the physical dimensions of each resonator, by the orientation of each resonator with respect to the other resonators, and by aspects of the top surface metallization pattern.

Although such RF signal filters have received widespread commercial acceptance since the 1970s, efforts at improvement on this basic design have continued to the present.

For example, there continues to exist a need to increase power-handling capabilities of ceramic filters for higher power applications. Currently, increasing the ceramic body size and/or the top pattern gaps to their maximum is the primary method used to increase the power handling capability of monoblock filters. Increasing the gaps in some cases, however, reduces the electrical performance of the filter and creates manufacturing sensitivity issues. Moreover, and where size and space is a limitation, increasing the size of the ceramic body is not an option.

Therefore, the need continues for an improved RF monoblock filter which can offer improved and increased power handling capabilities without either an increase in the size of the filter or an increase in the size of the gaps in the top metallization pattern.

SUMMARY OF THE INVENTION

It is a feature of the invention to provide a ceramic monoblock filter comprising a block of dielectric material defined by top, bottom, and side surfaces wherein the side and bottom surfaces are substantially covered with a conductive material.

A plurality of spaced-apart resonators are defined by a plurality of spaced-apart resonator through-holes extending between the top and bottom surfaces of the block and surrounded on the top surface by conductive material defining conductive resonator plates. A pattern of conductive material on the top surface defines at least an input/output transmission line defined by a first elongate strip of conductive material extending on the top surface between, and spaced from, first and second ones of the plurality of resonators.

The pattern additionally defines a bar on the top surface defined by a second strip of conductive material. The bar extends above and is spaced from the resonator plates defining the first and second resonators. The bar is located generally opposite and spaced from a top edge of the input/output transmission line.

The pattern still further defines a ground plate defined by one or more additional strips of conductive material on the top surface. The ground plate is coupled to the conductive material covering the side surfaces and is located generally opposite and spaced from the bar.

In one embodiment, the ground plate and the bar include respective interdigitated extension strips of conductive material defining a load splitting capacitor between the bar and the ground plate. In one embodiment, the respective interdigitated spaced-apart extension strips are generally spiral-shaped.

The input/output transmission line and the bar may additionally define respective interdigitated spaced-apart extension strips of conductive material defining a load splitting capacitor between the bar and the input/output transmission line.

Additional load splitting capacitors may be defined by extending terminal end portions of the bar over respective portions of the first and second resonators.

There are other advantages and features of this invention, which will be more readily apparent from the following detailed description of preferred embodiments of the invention, the drawings, and the appended claims.

BRIEF DESCRIPTION OF THE DRAWINGS

These and other features of the invention can best be understood by the following description and the accompanying FIGURES as follows.

DETAILED DESCRIPTION OF THE PREFERRED EMBODIMENT

While this invention is susceptible to embodiment in many different forms, this specification and the accompanying FIGURES disclose only one preferred form as an example of the invention. The invention is not intended to be limited to the embodiment so described, however. The scope of the invention is identified in the appended claims.

Figure 1:
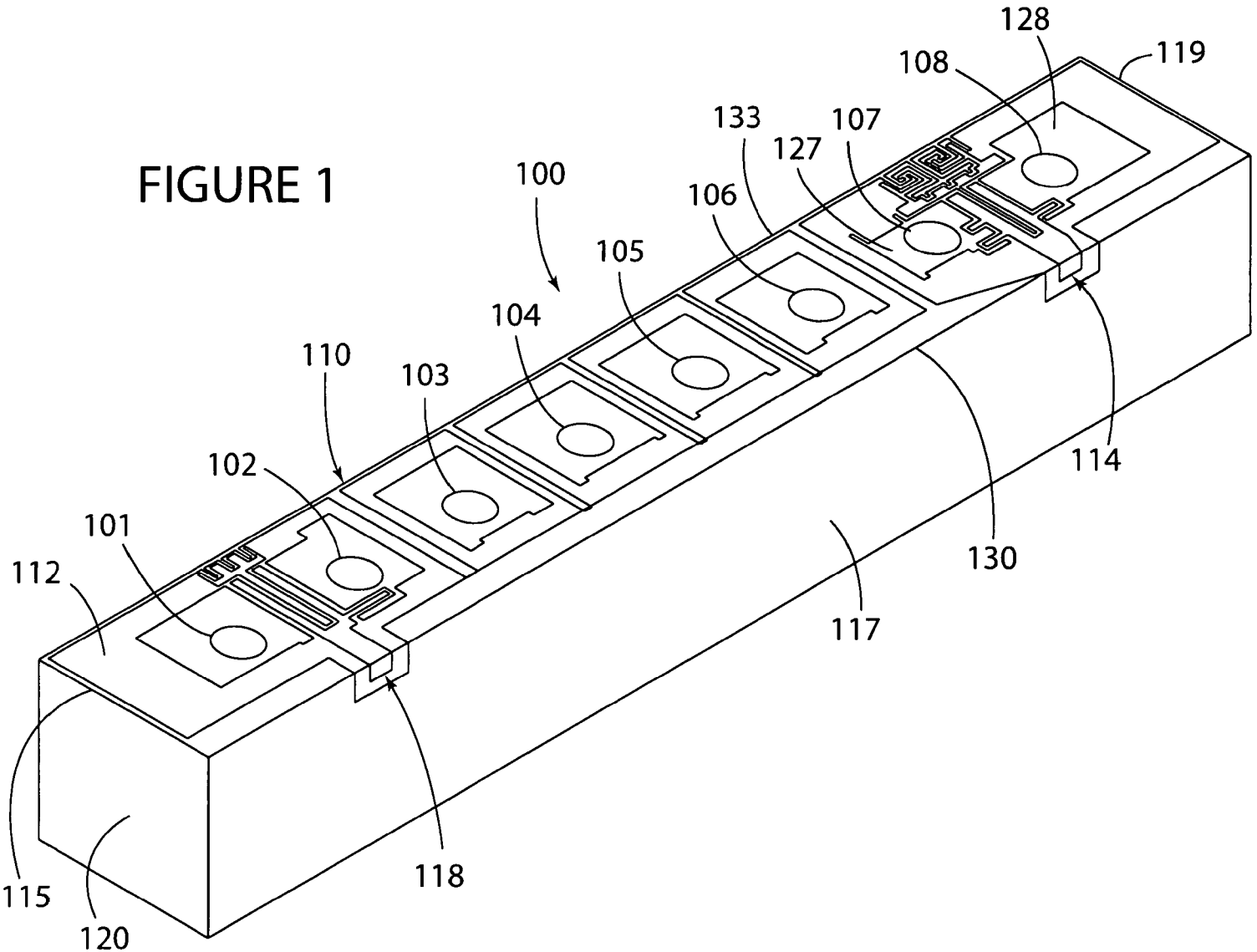
FIG. 1 is an enlarged perspective view of a ceramic monoblock filter incorporating the features of the present invention.
Figure 3:
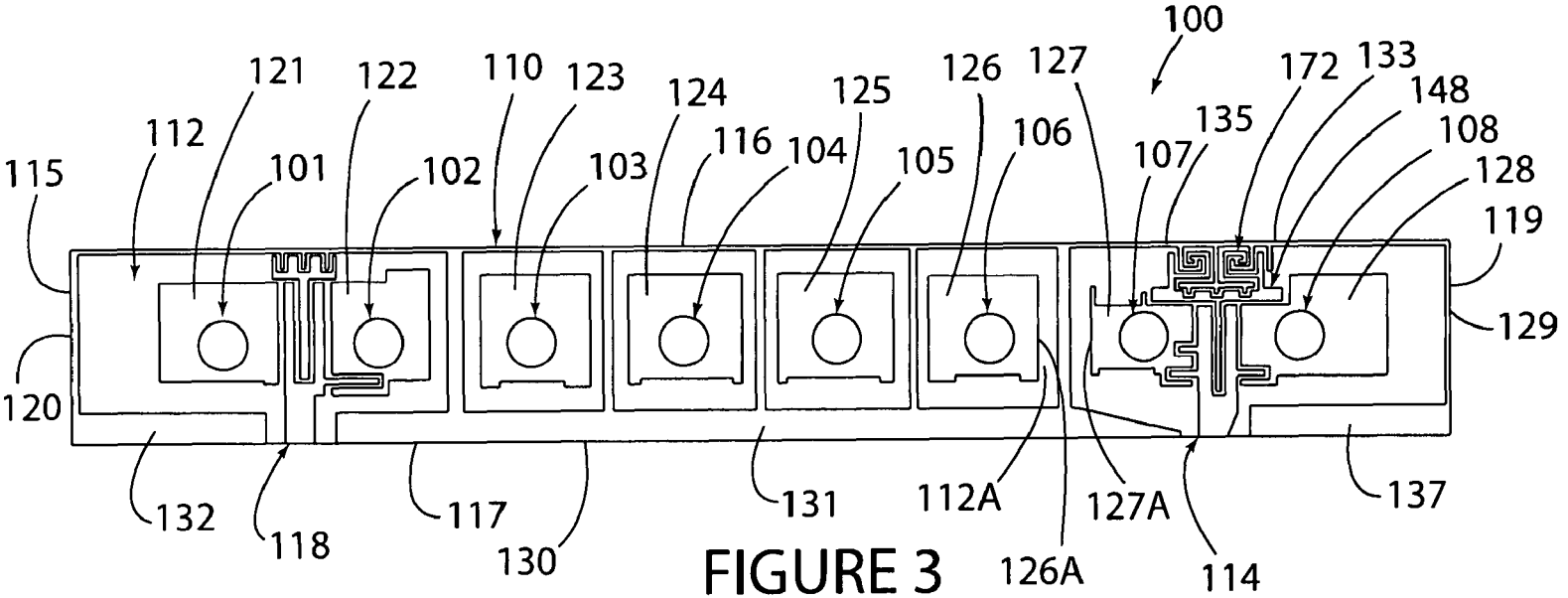
FIG. 3 is an enlarged top plan view of the metallization pattern on the top surface of the ceramic monoblock filter shown in FIG. 1.
Figure 4:
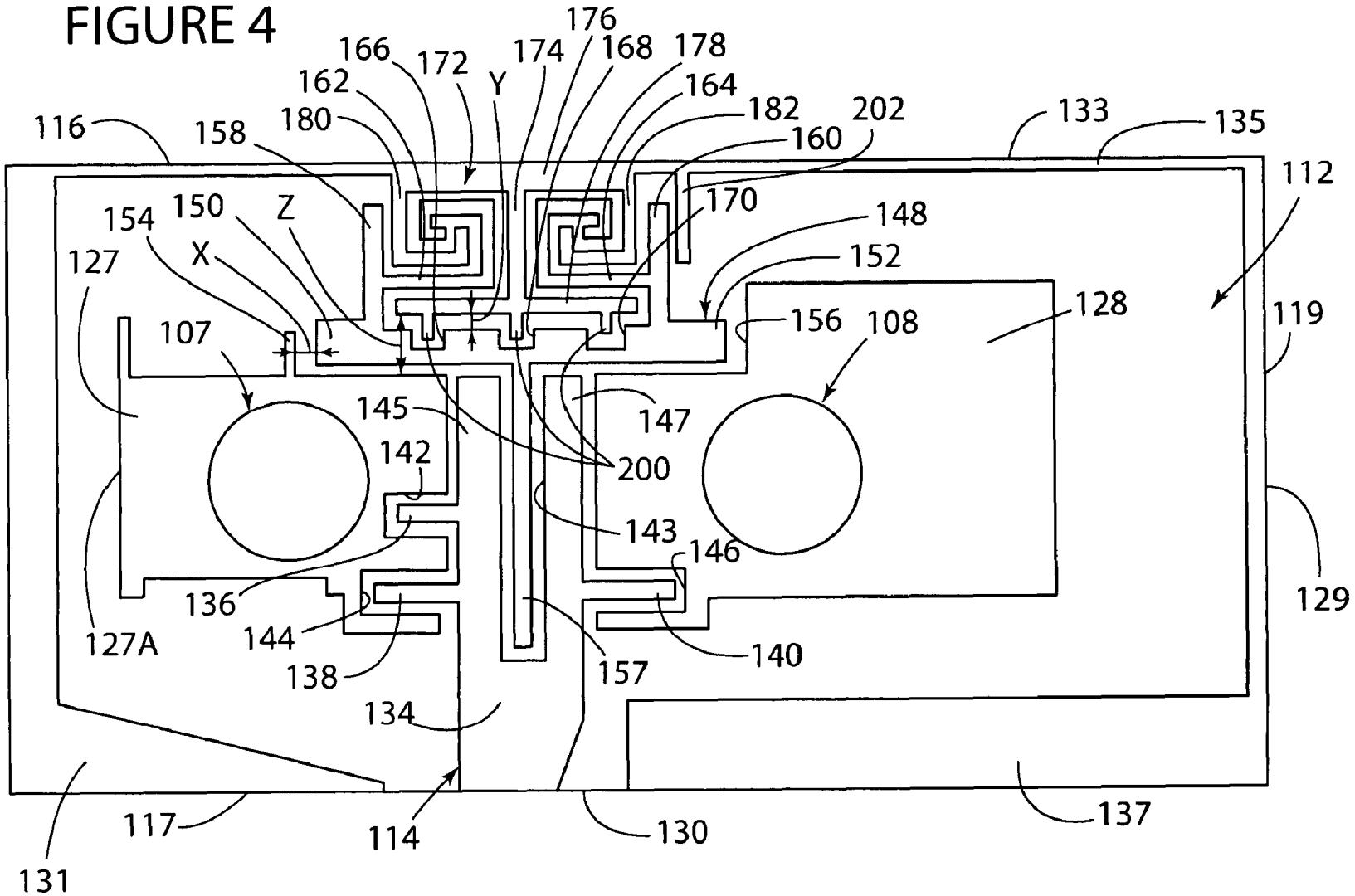
FIG. 4 is an enlarged, broken, top plan view of the input port capacitive loading metallization pattern of the filter shown in FIG. 1.

FIGS. 1, 3, and 4 show a preferred embodiment of a filter 100 (FIGS. 1, 3) which incorporates the increased and improved power handling metallization pattern features of the present invention.

Filter 100 includes a block 110 (FIG. 1) composed of a dielectric material and selectively plated with a conductive material. Block 110 has a top surface or face 112, a bottom surface (not shown) and four side surfaces or faces 116 (FIGS. 3, 4), 117, 120 (FIGS. 1, 3), and 129 (FIGS. 3, 4). Filter 100 can be constructed of a suitable dielectric material that has low loss, a high dielectric constant, and a low temperature coefficient.

The plating or material on block 110 is electrically conductive, preferably copper, silver or an alloy thereof. Such plating or material preferably covers all surfaces of the block 110 to define ground with the exception of top surface 112, the plating of which is described in some detail below.

In the embodiment of FIGS. 1, 3, and 4, block 110 includes eight (8) through-holes 101, 102, 103, 104, 105, 106, 107, and 108 (101-108) as shown in FIGS. 1 and 3, each extending from the top surface 112 to the bottom surface (not shown). The interior walls defining through-holes (101-108) are likewise plated with an electrically conductive material. Each of the plated through-holes 101-108 is essentially a transmission line resonator/pole comprised of a short-circuited coaxial transmission line having a length selected for desired filter response characteristics. For an additional description of the through-holes 101-108, reference may be made to U.S. Pat. No. 4,431,977, to Sokola et al. Although block 110 is shown with eight plated through-holes 101-108, the present invention is not so limited and encompasses filters with more or fewer through-holes.

Top surface 112 of block 110 defines opposed peripheral longitudinal edges 130 and 133, opposed peripheral side edges 115 (FIGS. 1, 3) and 119, and is selectively plated with an electrically conductive material similar to the plating on block 110. The selective plating includes and defines respective RF signal input-output (I/O) transmission lines/ pads/ plates, specifically input electrode/port/line 114 and output electrode/port/line 118 (FIGS. 1, 3). Also included are conductive resonator plates 121, 122, 123, 124, 125, 126, 127, and 128 (121-128) that surround respective through-holes 101, 102, 103, 104, 105, 106, 107, and 108 and in combination define respective resonators. Each of the plates 121, 122, 123, 124, 125, 126, 127, and 128 are separated by regions devoid of conductive material and each defines respective opposed and spaced-apart plate edges such as, for example, as depicted in FIG. 3 which identifies edge 126A of plate 126, edge 127A of plate 127 and unmetallized region 112A therebetween.

Top surface 112 additionally defines at least four ground plates 131, 132, 134, and 135 as shown in FIG. 3. Plates 121-128 are used to capacitively couple the transmission line resonators, provided by the plated through-holes 101-108, to ground plating or strips 131, 132, 137, and 135 which are coupled to the ground material which covers the respective side and bottom surfaces. Portions of plates 121-128 also couple the associated resonators of through-holes 101-108 to the input electrode 114 and the output electrode 118.

Ground plate or strip 131 is located on the top filter surface 112 and extends along a central portion of the peripheral lower edge of top surface 112 generally longitudinally between the input and output ports 114 and 118. Opposed terminal ends of plate 131 are spaced from the ports 114 and 118. Ground plate 132 is also located on the filter top surface 112 and extends generally longitudinally along the lower edge of top surface 112 generally between the edge 115 of side surface 120 and the output port 118. Plate 132 is spaced from the port 118. Ground plate 137 is located on the top filter surface 112 and extends along the lower edge of surface 112 generally between the edge 119 of opposed side surface 129 and the input port 114. Plate 137 is spaced from the port 114. Ground plate or strip 135 is located on the top surface 112 and extends the full length of the filter along the top longitudinal edge 133 of the filter 100.

Coupling between the transmission line resonators, provided by the plated through-holes 101-108, is accomplished at least in part through the dielectric material of block 110 and is varied by varying the width of the dielectric material and the distance between adjacent transmission line resonators. The width of the dielectric material between adjacent through-holes 101-108 can be adjusted in any suitable regular or irregular manner as is known in the art, such as, for example, by the use of slots, cylindrical holes, square or rectangular holes, or irregular-shaped holes.

The present invention is directed to the metallization pattern on the top surface 112 of filter 100 and, more specifically, the portion of the metallization pattern in the region of the input pad or port 114 which, as described in more detail below, is adapted to improve input capacitive coupling to ground which, in turn, increases the power load characteristics and abilities of the filter.

Referring to FIGS. 1 and 4, it is understood that input transmission port or pad or line 114 is defined by an elongate strip of metallized/conductive material which bridges the top and side surfaces 112 and 117 (FIG. 1) respectively. More specifically, input port 114 defines a first portion of a strip of conductive material located on the side surface 117; a second strip which wraps around and bridges the edge 130 between side surface 117 and top surface 112; and a third elongate strip portion which extends generally between and spaced from the metallized resonator plates 127 and 128. Input port or pad 114 preferably extends in a relationship spaced from and parallel to the resonator plates 127 and 128 and a relationship generally transverse to the top lower and upper longitudinal filter edges 130 and 133 respectively.

As shown in FIG. 4, the input pad 114 additionally defines strips of metallized material defining a plurality of fingers 136, 138, and 140 extending generally perpendicularly outwardly from opposed sides of the top portion of input pad 114 extending between respective resonator plates 127 and 128. Fingers 136, 138, and 140 are interdigitated into (i.e., protrude into) respective grooves 142, 144, and 146 defined in respective resonator plates 127 and 128. The grooves 142, 144, and 146 of course define regions devoid of metallized material. The fingers 136, 138, 140 are spaced from the metallized material defining the plates 127 and 128.

The top portion of input pad 114 extending between respective resonator plates 127 and 128 still further defines a central elongate groove 143 defining a fork having at least two tines 145 and 147 extending in a direction generally perpendicular to the upper top longitudinal filter edges 130 and 133. Groove 143 defines a region devoid of conductive material.

The metallization pattern on the input side of the filter 100 is still further defined by an elongate strip or bar 148 (FIGS. 3, 4) of metallized conductive material located above the respective resonator plates 127 and 128 and extending in an orientation and placement generally parallel to and spaced from the upper edges of respective resonator plates 127 and 128. Bar 148 extends in a direction parallel to the lower and upper longitudinal filter edges 130 and 133.

Bar 148 more specifically defines a central portion and respective opposed terminal end portions 150 and 152. The central portion is located and positioned generally opposite the ends of bar tines 145 and 147, and the respective end portions 150 and 152 extend and overlap at least about ¼ of the length of the respective resonator plates 127 and 128 in a generally spaced-apart and parallel relationship thereto. Bar 148 is spaced from the top of the plates 127 and 128.

Resonator plate 127 additionally defines a strip or finger or extension 154 of metallized conductive material protruding generally perpendicularly outwardly and upwardly from the top longitudinal edge thereof in a generally transverse relationship to the bar 148 and spaced from the terminal end portion 150 of bar 148. The resonator plate 128 in turn defines an upper shoulder 156 which is spaced from the opposed terminal end portion 152 of bar 148.

Bar 148 still further defines a generally centrally located elongate first extension or strip or finger 157 of metallized conductive material extending generally perpendicularly outwardly and downwardly from a lower edge of the bar 148. Extension 157 is interdigitated into (i.e., protrudes into) the elongate groove 143 defined in the top portion of input pad 114. Extension 157 is spaced from the conductive material defining input pad 114.

Bar 148 still further defines a pair of second and third elongate metallization extensions/strips/fingers 158 and 160 protruding and extending generally perpendicularly upwardly and outwardly from a top longitudinal edge of each of the respective bar terminal end portions 150 and 152. Bar extensions 158 and 160 are oriented and located relative to each other in a spaced-apart, parallel relationship. A pair of further metallization extensions/strips/fingers 162 and 164 protrude generally normally inwardly from the opposed respective inner edges of bar extensions 158 and 160. Extensions 162 and 164 define bent, curved, or spiral-shaped fingers.

Bar 148 still further defines a plurality of grooves 166, 168, and 170 protruding into the top edge thereof and extending along the length thereof in a generally spaced-apart and parallel relationship. Grooves 166, 168, and 170 define regions devoid of conductive material.

The metallization pattern in accordance with the present invention still further comprises a grounded plate extension 172 (FIG. 3) composed of one or more strips or bars or extensions or fingers of metallized material on the top filter surface 112 which protrude unitarily inwardly and outwardly from the grounding plate 135 extending along the top edge 133 of filter 100.

The grounded plate extension 172 is located generally opposite and spaced from the bar 148. In the embodiment of FIG. 4, grounded plate extension 172 is defined by respective strips 174, 176, and 178 of metallized material which in combination define an "I-beam" shaped metallization pattern. Strip 176 is a unitary, integral extension of plate 135, extends along the top filter edge 133 of filter 100 and preferably has a width greater than the width of the ground plate 135. Strip 178 is spaced from the strip 176 and is intercoupled thereto by the strip 174 which extends therebetween in a generally transverse relationship.

In accordance with the present invention, grounded plate extension 172 and, more specifically, strips 174 and 178 thereof, are spaced and split from the bar 148.

Grounded plate extension 172 is still further defined by a pair of strips, extensions, or fingers of metallized material extending downwardly and inwardly from opposed terminal end portions of the strip 174 and defining respective curved or spiral-shaped terminal fingers 180 and 182 which, in the embodiment shown, are similar in shape and configuration to, but mirror images of, the fingers 162 and 164 defined on bar 148.

Spiral-shaped fingers 162 and 164 and fingers 180 and 182 are respectively meshed/interwoven/interconnected/interdigitated together in a spaced-apart relationship and are separated and surrounded by regions devoid of conductive material so as to define an indirect capacitive coupling between the bar 148 and ground plate 135 as described in more detail below.

In the embodiment of FIG. 4, grounded plate extension 172 is located generally in the space defined between the fingers 158 and 160 of bar 148 in a relationship wherein the strip 178 of grounded plate extension 172 is spaced from and parallel to the bar 148; tabs or fingers 200 on strip 178 are interdigitated into (i.e., protrude into) the respective grooves 166, 168, and 170 defined in bar 148 in a relationship spaced from the conductive material defining the bar 148 and the fingers 180 and 182 of grounded plate extension 172 are spaced from the respective fingers 158 and 160 of bar 148. Taps 200 extend generally normally outwardly from the strip 178.

Top surface 112 defines an additional strip 202 of conductive material extending normally inwardly from the top ground plate 135. Strip 202 is located between and spaced from bar extension 160 on one side and the left side edge of resonator plate 128 on the other side. Strip 202 and bar extension 160 are disposed relative to each in a parallel relationship.

By way of background, it is known that the power handling of filters is directly related to the component with the greatest increase in stored energy. In ceramic monoblock filters, the circuit pattern incorporated onto the ceramic block forms capacitors to ground and capacitors between resonators. The capacitors with the most stored energy are the components with the greatest likelihood of arcing from high power. The input pad metallization pattern of the present invention increases the power handling of ceramic monoblock filters by modifying the components with the greatest chance of arcing. This is done by splitting the stored energy among two or more series connected capacitors.

Illustration A below shows a 1 Farad capacitor with 1 volt applied. In this example, the stored energy "E" is equal to the ½ $CV^2$ where C corresponds to capacitance and V corresponds to voltage. This calculates to (½)*(1F)*(1V)=½ Joule. If the circuit of Illustration A is changed to the equivalent electrical circuit shown in Illustration B, the arcing potential is reduced.

Illustration A

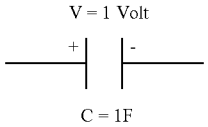

In Illustration B below, the total stored energy in the circuit is still ½ Joule. However, the stored energy in each of the capacitors (C1 and C2) is equal to ½ C1 *V1$^2$=½ C2*V2$^2$ where C1 and C2 corresponds to capacitance and V1 and V2 corresponds to voltage. This calculates to (½)*(2F)*(½)$^2$=¼ Joule. Each capacitor now has ½ the stored energy of the Illustration A capacitor. Note that the stored energy is related to the squared voltage ($V^2$). In electromagnetic theory, the electric field strength is directly related to the voltage. Arcing occurs when the electric field strength increases such that the breakdown voltage of air (29000V/cm) is exceeded, creating a conductive path between the two metallic plates of the capacitor. The breakdown of air has units of volts-per-centimeter which, of course, means that the spacing of the capacitive plates is an important variable in arcing. As the capacitive plates are moved closer together, the probability of arcing increases.

Illustration B

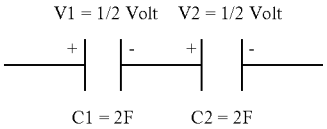

The Illustration B capacitive values are greater than the Illustration A capacitor value. The larger the capacitive value, the closer the metallic plates have to be located. This decreases the power handling. However, where space permits on the monoblock filter, the plate's surface area can be increased to maintain the desired capacitive value and still keep the wider plate spacing. The wide plate spacing in combination with the lower capacitive stored energy can increase the power handling of a filter.

Figure 6:
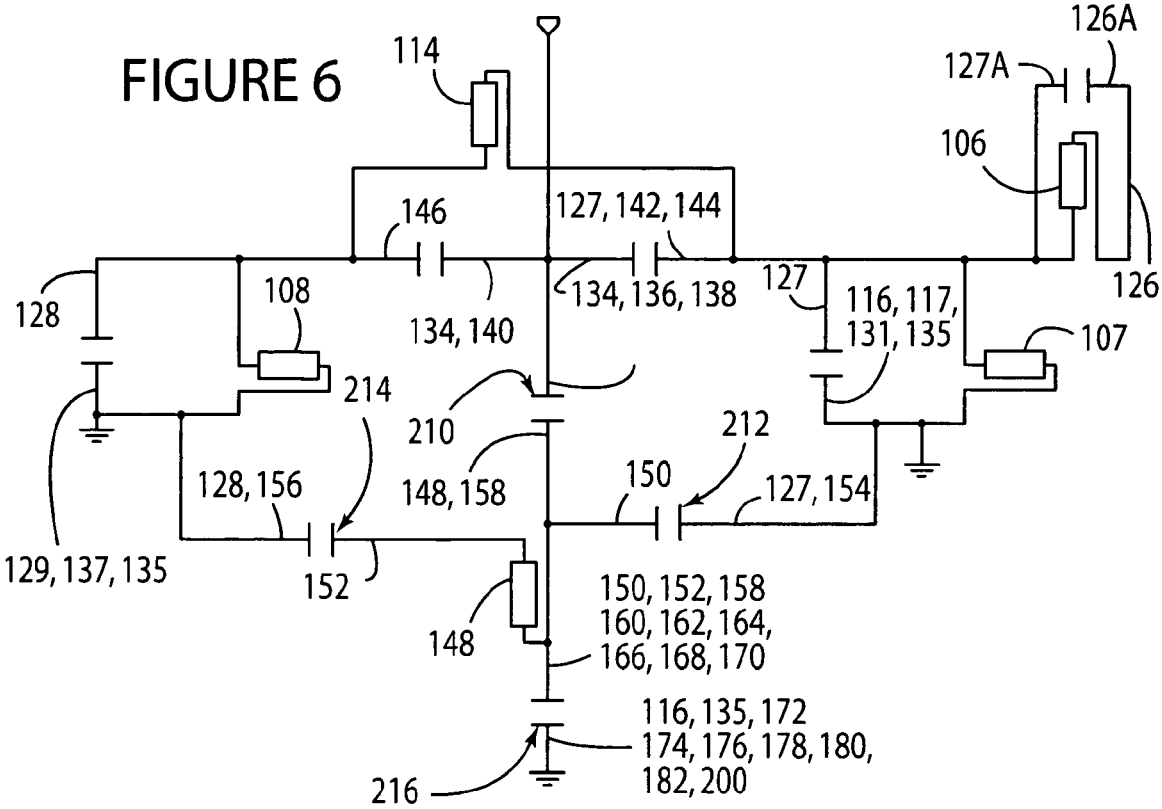
FIG. 6 is a schematic of the electrical circuit defined by the input port metallization pattern of the filter of the present invention shown in FIGS. 1 and 4.

In accordance with the present invention and referring to FIGS. 4 and 6 in particular, it is understood that input transmission line or port 114, resonators 127 and 128, and grounded plate extension 172 (FIG. 4) in combination define multiple sources of capacitive loading to the input transmission line or port 114 via the power load distribution bar 148. More specifically, it is understood that the polarity of ground extension plate 172 is negative and that the polarity of the input pad 114 is positive. When a load is applied to the filter 100, the polarity of the metallization pattern defining bar 148 will change to positive. Because the bar 148 is capacitively loaded to multiple sources as described above, the effect is the same as directly loading the input to ground as is known in the art and shown in the input port metallization pattern 302 of the prior art filter 300 shown in FIG. 2 and briefly described below.

Figure 2:
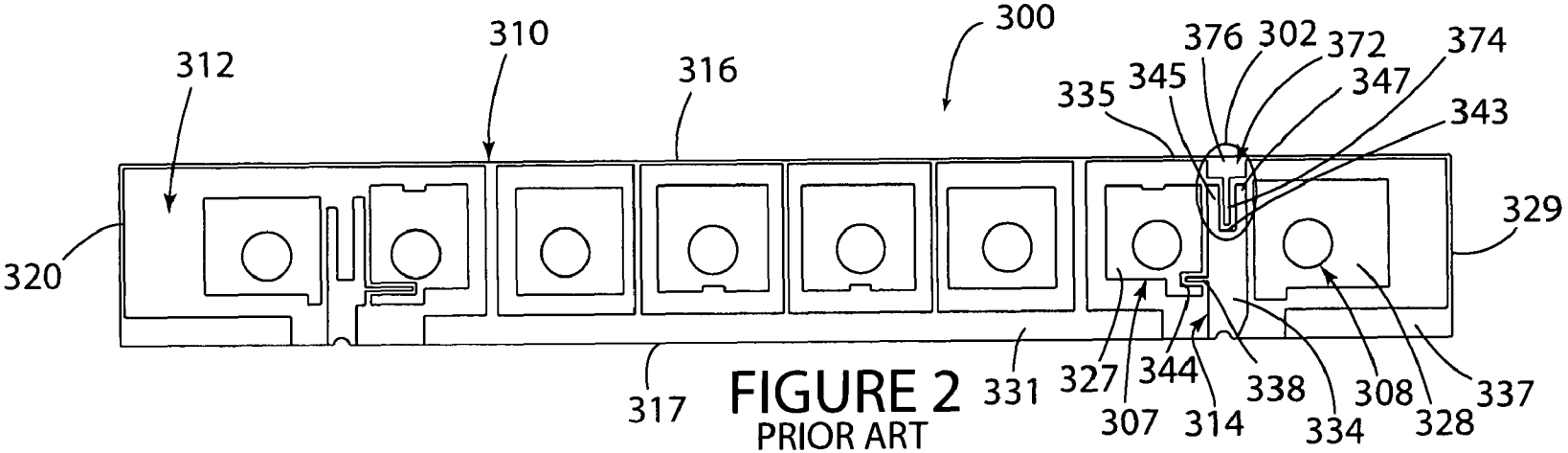
FIGURE 2 PRIOR ART
FIG. 2 is a top plan view of the top face of a filter incorporating a prior art input port capacitive loading metallization pattern.

Filter 300 shown in FIG. 2 includes a block 310 composed of a dielectric material and selectively plated with a conductive material. Block 310 has a top surface or face 312, a bottom surface (not shown) and four side surfaces or faces 316, 317, 320, and 329. Filter 300 can be constructed of a suitable dielectric material that has low loss, a high dielectric constant, and a low temperature coefficient.

The plating or material on block 310 is electrically conductive, preferably copper, silver or an alloy thereof. Such plating or material preferably covers all surfaces of the block 310 to define ground with the exception of top surface 312, the plating of which is described in some detail below.

The block 310 includes eight (8) through-holes including through-holes 307 and 308, each extending from the top surface 312 to the bottom surface (not shown). The interior walls defining each of the through-holes including through-holes 307 and 308 are likewise plated with an electrically conductive material and serve the same purpose as the through-holes 101-108 of filter 100.

Top surface 312 of block 310 defines respective RF signal input-output (I/O) transmission lines/pads/plates including specifically an input electrode/port/line 314. Also included on the top surface 312 are a plurality of conductive resonator plates that surround the respective through-holes. Plates 327 and 328 surround the through-holes 307 and 308 and in combination define respective resonators. Each of the plates, including the plates 327 and 328, are separated by regions devoid of conductive material. Top surface 312 additionally defines at least three ground plates 331, 335, and 337 similar in placement and purpose to the ground plates 131, 135, and 137 on the top surface 112 of filter 100.

Input transmission port or pad or line 314 is defined by an elongate strip of metallized/conductive material 334 which bridges the top and side surfaces 312 and 317 respectively and extends on the top surface 312 generally between and spaced from the metallized resonator plates 327 and 328. The input pad 314 additionally defines a strip of metallized material defining a finger 338 extending generally normally outwardly from one of the sides of the input pad 314. Finger 338 is interdigitated into (i.e., protrudes into) a groove 344 defined in the resonator plate 327. Groove 344 defines a region devoid of metallized material and finger 338 is spaced from the metallized material defining the plate 327.

The top portion of input pad 314 still further defines a central elongate groove 343 devoid of conductive material and defining a fork having at least two tines 345 and 347.

The top surface 312 of filter 300 also includes a ground plate extension 372 of metallized material which extends unitarily outwardly from the ground plate 335, is located generally opposite and spaced from the input transmission pad 314, and is defined by respective strips of metallized material 374 and 376. Strip 376 is a unitary, integral extension of the strip 335. Strip 374 extends downwardly from the strip 376 between the resonator plates 327 and 328 and into the groove 343 in the input pad 314.

Figure 5:
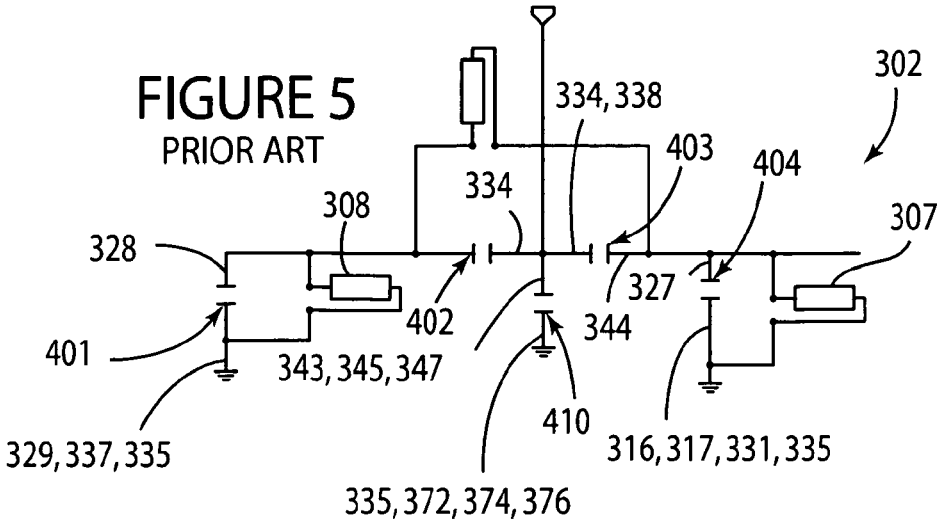
FIGURE 5 PRIOR ART
FIG. 5 is a schematic of the electrical circuit defined by the input port metallization pattern of the prior art filter shown in FIG. 2.

FIG. 5 is a schematic diagram of the electrical methodology and circuit of the input metallization pattern 302 of the prior art filter 300 shown in FIG. 2 and thus the reference numerals identified in FIG. 5 correspond to like reference numerals identified in FIG. 2 with the exception of the reference numerals 401, 402, 403, 404, and 410 in FIG. 5 and are not further described herein which identify the respective capacitors defined by the input metallization pattern 302 of filter 300. FIG. 6 is a schematic diagram of the splitting electrical methodology and circuit of the input metallization pattern of the filter 100 of the present invention as shown in FIGS. 3 and 4 and thus the reference numerals identified in FIG. 6 correspond to like reference numerals identified in FIGS. 3 and 4 and are not further described herein with the exception of the reference numerals 210, 212, 214 and 216 and, more specifically, the reference numerals 212, 214 and 216 which identify the power load splitting capacitors defined by the filter 100 of the present invention.

The metallization pattern in accordance with the present invention, however, affords the advantage of facilitating the distribution of the power load over the full length of the bar 148, thus increasing the amount of power load which the filter can handle.

Specifically, and still with reference to FIGS. 4 and 6 in particular, it is understood that, in accordance with the principles shown in Illustration B: downward extension 157 (FIG. 4) of bar 148 (FIGS. 4, 6) defines a capacitor 210 (FIG. 6) between bar 148 and input port 114 (FIGS. 4, 6) for splitting the power load between bar 148 and input port 114; terminal end portions 150 (FIGS. 4, 6) and 152 (FIGS. 4, 6) of bar 148 extend and overlie portions of respective resonator plates 127 (FIGS. 4, 6) and 128 (FIGS. 4, 6) to define additional respective capacitors 212 (FIGS. 6) and 214 (FIG. 6) between the bar 148 and resonator plates 127 and 128 for splitting the load between the respective resonator plates 127 and 128; and extensions 158 (FIGS. 4, 6) and 160 (FIGS. 4, 6) of bar 148 in combination with ground plate extension 172 (FIGS. 4, 6) define an additional capacitor 216 (FIG. 6) which splits the load between the input port 114 and ground plate 135 (FIGS. 4, 6).

In accordance with a preferred embodiment of the metallization pattern of the present invention, the distance, generally designated X in FIG. 4 between the finger 154 (FIGS. 4, 6) on resonator plate 127 and the terminal edge 150 (FIGS. 4, 6) of bar 148 is about 0.007 inches; the distance generally designated Y in FIG. 4, between the ground bar 178 (FIGS. 4, 6) and the power load distribution bar 148 is also preferably about 0.007 inches; and the distance, generally designated Z in FIG. 4, between the ground bar 178 and the top terminal edge of input transmission port 114 is preferably about 0.03 inches.

Figure 7:
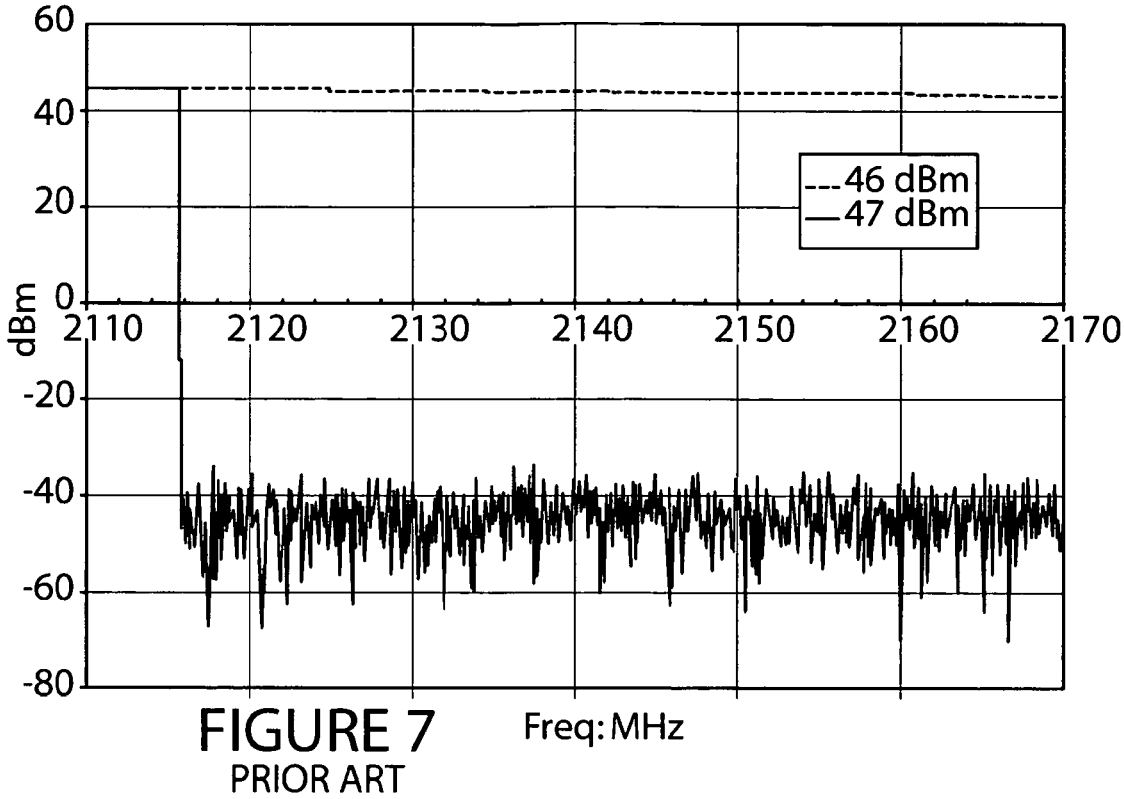
FIGURE 7 PRIOR ART
FIG. 7 is a graph depicting the power handling characteristics of the prior art filter of FIG. 2.
Figure 8:
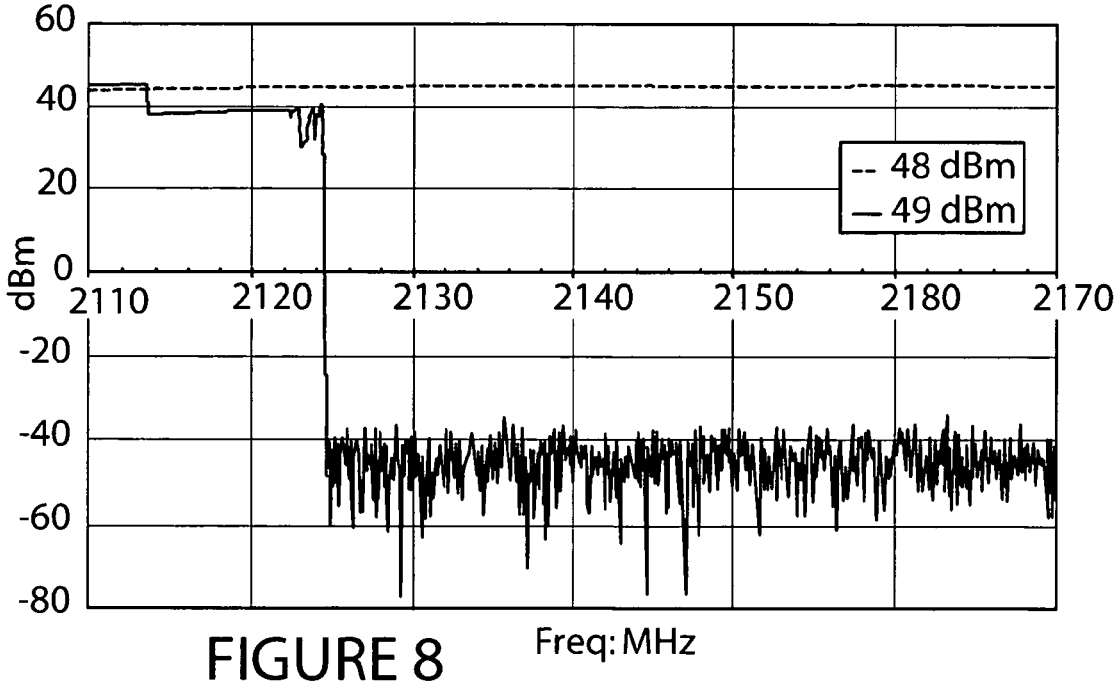
FIG. 8 is a graph depicting the power handling characteristics of the filter of FIG. 1.

FIGS. 7 and 8 in combination illustrate that the metallization pattern in accordance with the present invention has been shown to provide an increase in the filter power level from a reference power level of about 46 dBm and an actual power level of about 47 dBm/50 watts (as shown in FIG. 7 for the FIG. 2 prior art filter) to a reference power level of about 48 dBm and an actual power level of about 49 dBm/79 watts (as shown in FIG. 8 for the FIG. 1 filter) before there is a catastrophic failure.

Figure 9:
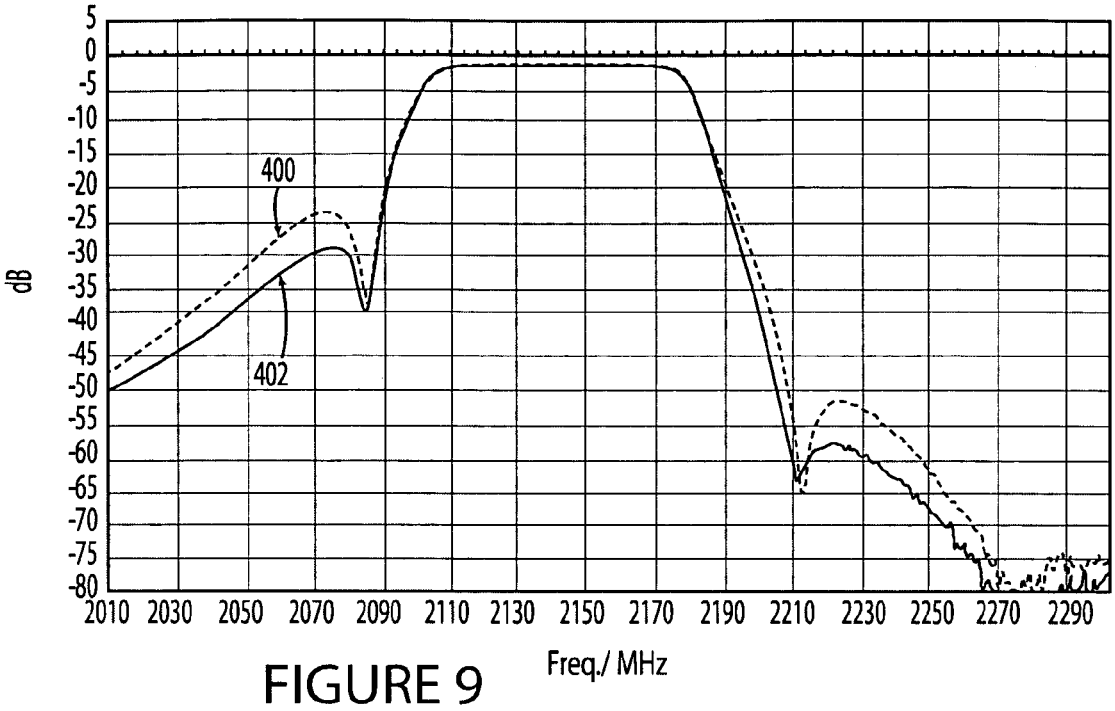
FIG. 9 is a graph comparing the performance characteristics of the filters of FIGS. 1 and 2.

FIG. 9 in turn illustrates that the metallization pattern in accordance with the present invention has also been shown to create a filter exhibiting "in band" performance characteristics similar to the prior art filter of FIG. 2 while, however, providing increased "out of band" rejection resulting from heavier loading to ground and source splitting via the bar 148. Line 400 in FIG. 9 represents the performance of the filter shown in FIG. 2. Line 402 in FIG. 9 represents the performance of the filter of the present invention.

Figure 10:
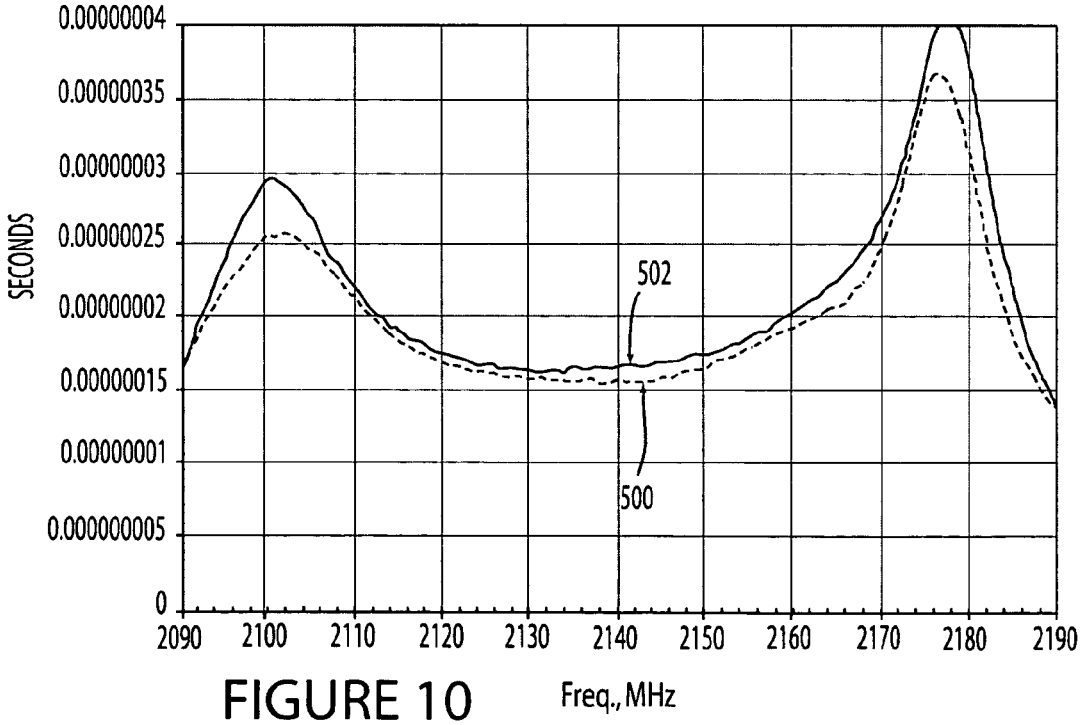
FIG. 10 is a graph comparing the delay characteristics of the filters of FIGS. 1 and 2.

FIG. 10 illustrates that the metallization pattern in accordance with the present invention not only allows the filter to handle increased power loads but also additionally advantageously causes an increase in the delay experienced by the filter 100 thus, of course, allowing the filter 100 to handle a higher power load for a longer period of time. Lines 500 in FIG. 10 represent the performance of the filter shown in FIG. 2. Lines 502 in FIG. 10 represent the performance of the filter of the present invention.

Numerous variations and modifications of the embodiment described above may be effected without departing from the spirit and scope of the novel features of the invention. No limitations with respect to the specific module illustrated herein are intended or should be inferred.

What is claimed is:

1. A ceramic monoblock filter, comprising:

a block of dielectric material defined by top, bottom, and side surfaces wherein said side and bottom surfaces are covered substantially with a conductive material, the conductive material on at least one of the side surfaces defining a ground plate and the top surface defining opposed upper and lower peripheral longitudinal edges;

a plurality of spaced-apart through-holes extending through the block between the top and bottom surfaces and surrounded on the top surface by conductive material defining conductive resonator plates;

a first strip of conductive material on the top surface defining an input/output transmission line, the first strip of conductive material extending between first and second ones of the conductor resonator plates;

a bar of conductive material defined on the top surface generally between the first and second ones of the resonator plates and the upper one of the opposed peripheral longitudinal edges, the bar of conductive material being separate and spaced from the first strip of conductive material and the ground plate; and means associated with the ground plate and/or the bar defining a power load splitting capacitor on the top surface.

2. The ceramic monoblock filter of claim 1 wherein the power load splitting capacitor is defined by first and second extension strips of conductive material unitary with the ground plate and the bar respectively.

3. The ceramic monoblock filter of claim 1 wherein the means associated with the bar defining the power load splitting capacitor is disposed between the bar and the input/output transmission line.

4. The ceramic monoblock filter of claim 1 wherein the means associated with the bar defining the power load splitting capacitors is disposed between the bar and the first and second ones of the resonator plates.

5. A ceramic monoblock filter, comprising:

a block of dielectric material defined by top, bottom, and side surfaces wherein said side and bottom surfaces are covered substantially with a conductive material, the conductive material on at least one of the side surfaces defining a ground plate and the top surface defining opposed upper and lower peripheral longitudinal edges;

a plurality of spaced-apart through-holes extending through the block between the top and bottom surfaces and surrounded on the top surface by conductive material defining conductive resonator plates;

a first strip of conductive material on the top surface defining an input/output transmission line, the first strip of conductive material extending between first and second ones of the conductor resonator plates;

a bar of conductive material defined on the top surface generally between the first and second ones of the resonator plates and the upper one of the opposed peripheral longitudinal edges; and means associated with the bar defining power load splitting capacitors on the top surface, the means being disposed between the bar and the first and second ones of the resonator plates, the bar including opposed terminal end portions overlapping respective portions of the first and second ones of the resonator plates, the terminal end portions defining the respective power load splitting capacitors correspondingly disposed between the bar and the first and second ones of the resonator plates.

6. A ceramic monoblock filter, comprising:

a block of dielectric material defined by top, bottom, and side surfaces wherein said side and bottom surfaces are covered substantially with a conductive material, the conductive material on at least one of the side surfaces defining a ground plate and the top surface defining opposed upper and lower peripheral longitudinal edges;

a plurality of spaced-apart through-holes extending through the block between the top and bottom surfaces and surrounded on the top surface by conductive material defining conductive resonator plates;

a first strip of conductive material on the top surface defining an input/output transmission line, the first strip of conductive material extending between first and second ones of the conductor resonator plates;

a bar of conductive material defined on the top surface generally between the first and second ones of the resonator plates and the upper one of the opposed peripheral longitudinal edges; and means associated with the ground plate and/or the bar defining a power load splitting capacitor on the top surface, the power load splitting capacitor being defined by first and second extension strips of conductive material unitary with the ground plate and the bar respectively, the respective first and second extension strips of conductive material being generally spiral-shaped and interdigitated together.

7. A ceramic monoblock filter, comprising:

a block of dielectric material defined by top, bottom, and side surfaces wherein said side and bottom surfaces are covered substantially with a conductive material, the conductive material on at least one of the side surfaces defining a ground plate and the top surface defining opposed upper and lower peripheral longitudinal edges;

a plurality of spaced-apart through-holes extending through the block between the top and bottom surfaces and surrounded on the top surface by conductive material defining conductive resonator plates;

a first strip of conductive material on the top surface defining an input/output transmission line, the first strip of conductive material extending between first and second ones of the conductor resonator plates;

a bar of conductive material defined on the top surface generally between the first and second ones of the resonator plates and the upper one of the opposed peripheral longitudinal edges; and means associated with the bar defining a power load splitting capacitor on the top surface, the means being disposed between the bar and the input/output transmission line and being defined by a strip of conductive material on the bar extending into a groove defined in the first strip of conductive material defining the input/output transmission line.

8. A ceramic monoblock filter, comprising:

a block of dielectric material defined by top, bottom, and side surfaces wherein said side and bottom surfaces are substantially covered with a conductive material;

a plurality of spaced-apart resonators defined by a plurality of spaced-apart resonator through-holes extending between the top and bottom surfaces of said block and surrounded on the top surface by conductive material defining conductive resonator plates; and a pattern of conductive material on the top surface defining at least:

an input/output transmission line defined by a first elongate strip of conductive material extending on the top surface between, and spaced from, first and second ones of the plurality of resonators;

a bar on the top surface defined by a second strip of conductive material, the bar spaced from and overlapping at least a portion of said resonator plates surrounding said through-holes defining said first and second resonators, the bar being located generally opposite and spaced from a top edge of said input/output transmission line; and a ground plate defined by one or more additional strips of conductive material on the top surface, the ground plate being coupled to the conductive material covering said side surfaces and being located generally opposite and spaced from said bar, the ground plate and the bar including respective extension strips of conductive material defining a load splitting capacitor between the bar and the ground plate.

9. The ceramic monoblock filter of claim 8 wherein the ground plate and the bar define respective interdigitated spaced-apart extension strips of conductive material.

10. The ceramic monoblock filter of claim 9 wherein the respective interdigitated spaced-apart extension strips are generally spiral-shaped.

11. The ceramic monoblock filter of claim 8 wherein the input/output transmission line and the bar define respective interdigitated spaced-apart extension strips of conductive material defining the load splitting capacitor disposed between the bar and the input/output transmission line.

12. A ceramic monoblock filter comprising:

a block of dielectric material defined by top, bottom, and side surfaces, the bottom and side surfaces being covered substantially by a conductive material;

a plurality of spaced-apart through-holes extending through the block between the top and bottom surfaces and surrounded on the top surface by conductive material defining conductive plates;

an input/output transmission line defined by a first strip of conductive material on the top surface, the input/output transmission line being located between first and second ones of the conductive plates;

a ground plate defined by a second strip of conductive material defined on the top surface;

a load splitting bar defined by a third strip of conductive material on the top surface defining opposed terminal ends overlapping opposed portions of the first and second ones of the resonator plates, the bar being spaced from both the input/output transmission line and the ground plate and defining at least a first extension strip of conductive material interdigitated with the second strip of conductive material defining the ground plate and at least a second extension strip of conductive material interdigitated with the first strip of conductive material.

13. The ceramic monoblock filter of claim 12 wherein the first extension strip of conductive material of the bar and the second strip of conductive material defining the ground plate are both spiral-shaped.

14. The ceramic monoblock filter of claim 12 wherein the first strip of conductive material defining the input/output transmission line defines a groove, the second extension strip of the bar protruding into the groove.

15. The ceramic monoblock filter of claim 12 wherein each of the first and second ones of the conductive plates defines at least one groove therein, the bar defining additional respective strips of conductive material protruding into the grooves defined in the corresponding conductive plates.

* * * * *